United States Patent [19]

Lundquist et al.

[11] 4,294,859

[45] Oct. 13, 1981

[54] PROCESS FOR PACKAGING FOOD

[75] Inventors: Burton R. Lundquist, Highland Park, Ill.; Thomas Macherione, Mesa, Ariz.

[73] Assignee: Armour and Company, Phoenix, Ariz.

[21] Appl. No.: 94,380

[22] Filed: Nov. 15, 1979

Related U.S. Application Data

[63] Continuation of Ser. No. 568,016, Apr. 14, 1975, abandoned.

[51] Int. Cl.[3] ..... B65B 31/04

[52] U.S. Cl. ..... 426/410; 53/408; 53/433; 53/434; 426/129; 426/418

[58] Field of Search ..... 426/129, 263, 316, 319, 426/396, 410, 412, 414, 492, 493, 418; 53/403, 408, 427, 433, 453, 511, 559, 434

[56] References Cited

U.S. PATENT DOCUMENTS

| | | | |
|---|---|---|---|
| 2,925,346 | 2/1960 | Harper et al. | 426/316 X |
| 3,061,984 | 11/1962 | Mahaffy | 53/433 |
| 3,102,777 | 9/1963 | Bedrosian et al. | 426/419 X |
| 3,299,607 | 1/1967 | Dopp et al. | 53/112 R |
| 3,353,218 | 11/1967 | Cloud et al. | 53/511 X |
| 3,673,760 | 7/1972 | Canamero et al. | 53/22 A |
| 3,701,229 | 10/1972 | Zelnick | 53/427 |
| 3,709,702 | 1/1973 | Mahaffy et al. | 53/22 A X |
| 3,725,081 | 4/1973 | Barham et al. | 426/312 X |

*Primary Examiner*—William A. Cuchlinski, Jr.

*Attorney, Agent, or Firm*—Frank T. Barber; Carl C. Batz

[57] ABSTRACT

A process for packaging units of food in which the food units are placed on a bottom film and slits made in the film. The film with the food units thereon is passed into an open chamber, the chamber closed, and a vacuum drawn on it followed by back-filling with a substantially oxygen-free gas. The film with the food units thereon and a top film over the units is then subjected to vacuum and the top and the bottom films sealed. Alternately the package may be back-filled with oxygen-free gas prior to being sealed about the food unit. The disclosure includes also the steps of partially sealing food units between top and bottom films in a first chamber, back-filling with a substantially oxygen-free gas, then vacuumizing in a second chamber, and fully sealing the packages in a second chamber, or alternately back-filling with the oxygen-free gas before fully sealing.

12 Claims, 13 Drawing Figures

PROCESS FOR PACKAGING FOOD

This is a continuation of application Ser. No. 568,016, filed Apr. 14, 1975 now abandoned.

This invention relates to the packaging of foods and more particularly to a process in which a food unit is enclosed in film and the amount and concentration of the oxygen within such film is reduced.

BACKGROUND

It has long been recognized that the quality of foods can be maintained for extended periods of time if they may be stored in an environment having reduced concentrations of oxygen. Meats are especially affected by oxygen, and meat items such as luncheon meats are extremely perishable in an atmosphere containing oxygen. In the presence of oxygen the food item, particularly meats, loses flavor and tends to spoil due to the growth of yeast, molds and some bacteria that develop rapidly in the presence of oxygen even during refrigerated storage. It is known that the volume of oxygen about the food may be reduced by enclosing the food unit in film having low oxygen permeability and sealing while under a vacuum. If the food unit is placed in a chamber, a vacuum of 29 inches mercury drawn on the chamber and the film sealed about the unit when it is under vacuum, a package may be obtained having a vacuum of about 24 to 26 inches mercury, but the concentration of oxygen within the package remains at about 20%. For example, in a 2-ounce package of bologna (2 slices) 0.47 to 0.99 cc of air having an oxygen concentration of 20% is left in the package apart from what may be in the meat body itself. This amounts to 0.094 to 0.198 cc of oxygen. The oxygen is also entrapped within the meat. In the example of the 2-ounce bologna package, the meat itself contains 0.16 to 0.33 cc of entrapped and absorbed air, which computes to 0.032 to 0.066 cc of oxygen. This comes to a total of 0.125 to 0.264 cc of oxygen still contained within the typical vacuumized package previously known in the art. Such a package is known to have a shelf life, under ordinary marketing conditions, of from 30 to 60 days.

We have sought to discover processes for packing units of food in a film enclosure in which the volume and concentration of oxygen within the package and in the food unit is substantially reduced from that of the prior practice as above explained and which will result in packages which have a much longer shelf life. This discovery and other objects and advantages of my invention will become apparent as this specification proceeds.

DETAILED DESCRIPTION

Suitable apparatus for use in the conduct of our invention is contained in the accompanying drawings in which FIG. 1 is an overall front perspective view of the machine;

As illustrated, the apparatus includes a cutter unit C for providing slits in the lower film, a first chamber D, a gas-flushing area E, a second chamber F, and a cutting area G at which the films are cut to make individual packages.

Figure 1:
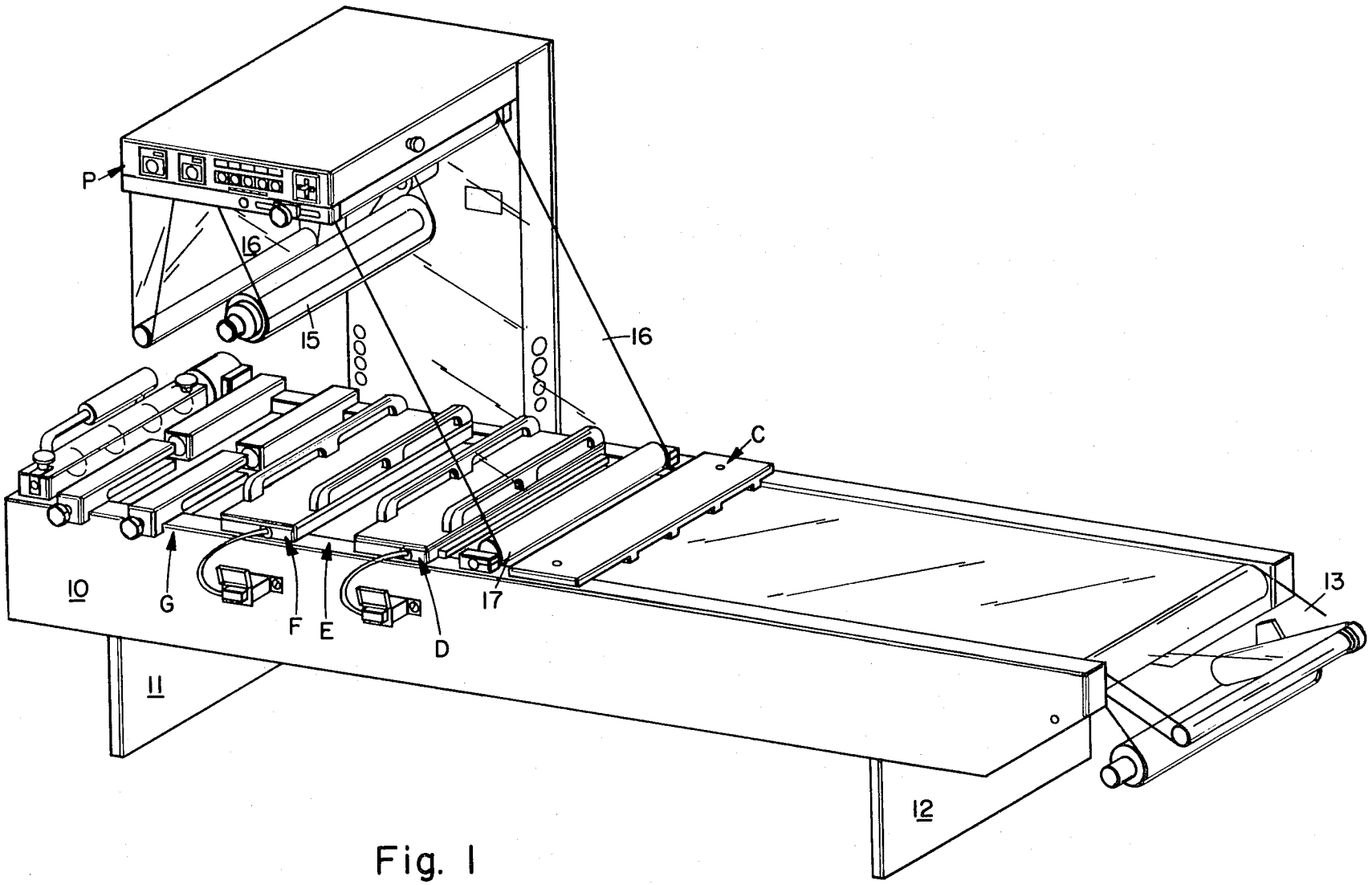
Figure 2:
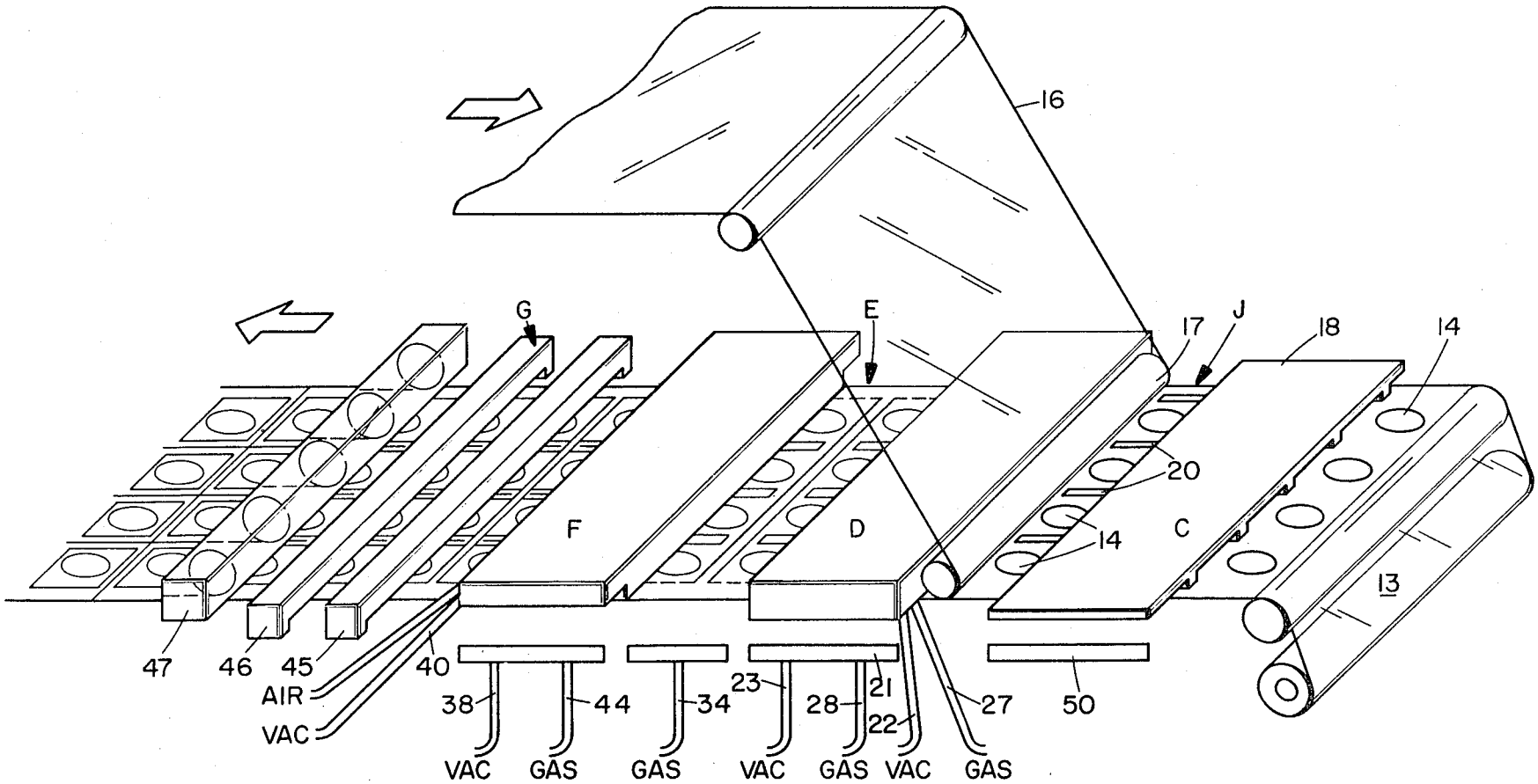
FIG. 2 is a schematic perspective view illustrating the principal apparatus units which act in sequence to prepare the improved package.
Figure 4:
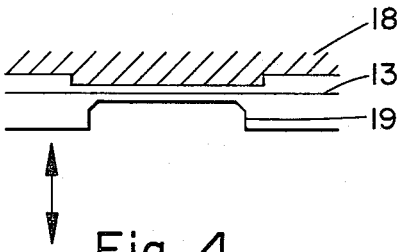
FIG. 4 is a detailed schematic view of the knife below the lower film and the direction the knife moves to cut the slit in the lower film and then to withdraw.

Referring to FIGS. 1 and 2, the machine has a frame 10 supported by the legs 11 and 12, and carried in the frame are the sections or units C, D, E, F and G. Above frame 10 is the control panel P.

A roll of film 13 is rotatably mounted at the input end of the machine, and the film coming from this roll is passed forwardly over the top of the horizontal table of the machine. This film, designated 13, becomes the bottom of the package. As the film 13 passes forwardly over the table at the input end of the machine, there is placed upon it spaced food units 14 each of which may include, for example, two 1-ounce slices of bologna. The bottom film 13 with the food units thereon passes forwardly through cutter section C, then through chamber D, then to area E which is between chambers D and F, then through chamber F and comes to the section G where it is cut.

A second roll of film 15 is rotatably mounted above frame 10 and the top film 16 from this roll is led under the roll 17 where it forms a cover over the food units and moves forwardly along with the food units and the bottom film 13 through the sections D, E, F and G.

Although the roll 17 which introduces the film 16 to its position on top of the food units, is illustrated as located back of the first chamber D, this roll could be located on the forward side of chamber D. Preferably this roll is located as it is illustrated.

In the embodiment illustrated the machine is designed to advance the films intermittently, eight food units at a time, which involves two rows of units with four units in each row. It is apparent that the machine could be designed to advance at one time any number of rows with any number of units in each row. Our process is effective in the packaging of any food but more particularly meat products such as luncheon meats and similar items.

Figure 3:
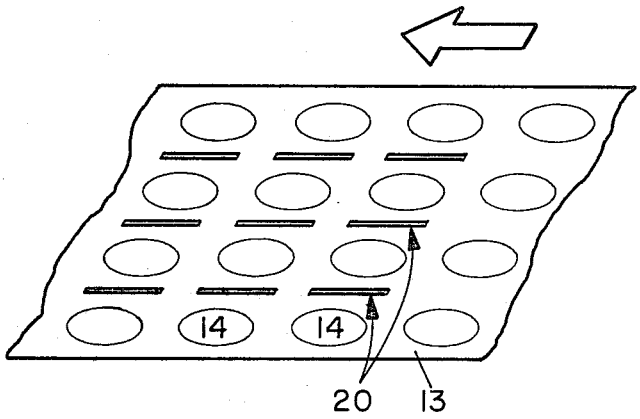
FIG. 3 is a detailed schematic representation showing the placement of food units and the location of slits in the lower film.

As illustrated, each advance of the film passes eight units under the plate 18 of section C. Below plate 18 and under bottom film 13 are spaced knives 19 (see FIGS. 3 and 4) which were in their downward or retracted position when the film was advanced to this position. As the knives are raised, they push the film against a backup pad to cut slits 20 in the film 13. These knives are subsequently lowered again after the slits have been cut to permit the film to move without interference the next time it is advanced. The slits cut in film 16 may vary in size. Ordinarily they may be of the order of 2 or 3 inches in length but in the cases of larger-sized food units, the sizes of the slits may be increased.

The next advance of film 13 brings the two rows of food units to a position between the units C and D and the following advance brings these same units into the first chamber D, the lower section 21 of which is then in lowered position to open the chamber and permit the movement of the films together with the eight food units into the chamber.

Then the section 21 is raised to close the chamber D, providing an airtight closure. The vacuum lines 22 and 23 are then opened. Line 22 leads from the head of chamber D and line 23 leads from a position below the film 13. In this way the vacuum of about 29 or 29½ inches of mercury may be drawn in the chamber. Air is also drawn from the food units through the slits and this air withdrawn through lines 23.

Figure 6:
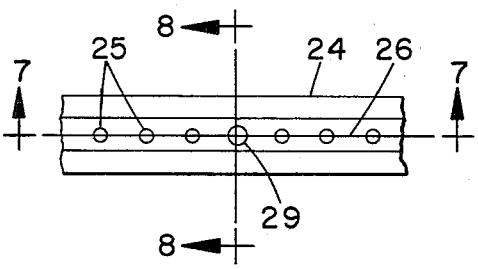
FIG. 6 is a detailed planar view of the openings to the gas passages in the first and second chambers.
Figure 8:
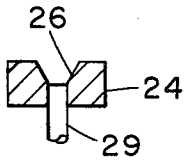
FIG. 8 is also a vertical sectional view but as seen from line 8—8 in FIG. 6.
Figure 9:
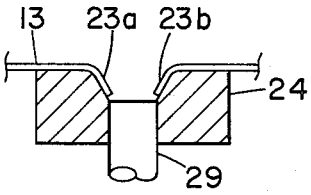
FIG. 9 is an enlarged view similar to FIG. 8, but showing the slit in the lower film and how the edges are drawn down.
Figure 7:
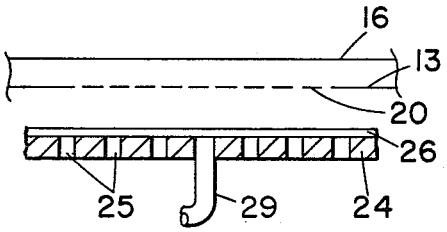
FIG. 7 is a vertical sectional view as seen from line 7—7 of FIG. 6 and showing also the relative position of the top and bottom films and illustrating the slot contained in the lower film.
Figure 5:
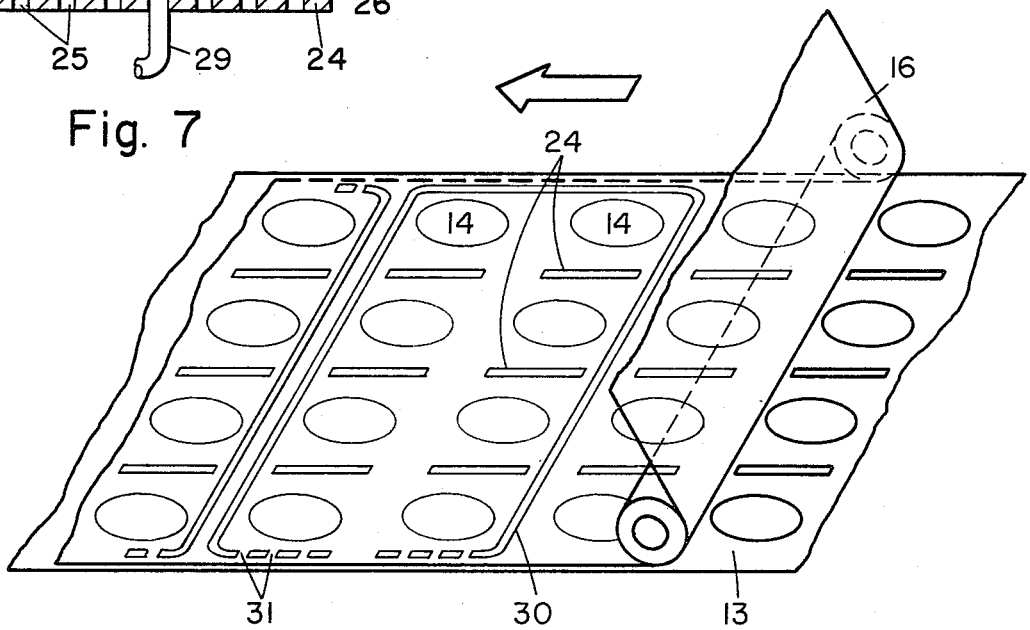
FIG. 5 is a schematic view showing the position of the openings for withdrawing and admitting gas with respect to the films and food units, and the lines of sealing in the first chamber.

At this point reference is made to FIGS. 5 and 9. As the food units and film come to the prescribed position within chamber D, slits in film 13 are immediately over a matrix 24 (FIG. 6) containing orifices 25. Orifices 25 are connected with line 23 to provide passages leading from below the slits to the source of the vacuum. A trough 26 having V-shaped sides is provided in the top of this matrix. This trough is aligned with the slit in the film 13 thereabove and the orifices 25 are in the bottom of this trough.

When the vacuum is applied through passages in lines 23 air is withdrawn through slits 20 and the edges of the slits **23*a* and 23*b* are drawn down against the interior side of trough 26 (see FIG. 9**) so as to enlarge the opening provided by the slits.

After the vacuum has been drawn, a partial seal is made between the top and bottom films within chamber D, the seal being made by heat sealing along a line 30 extending about the eight units within the chamber, the line being discontinued at some places so as to provide at least one opening 31 between top film 16 and bottom film 13.

Although we prefer that the films be sealed as above mentioned, after the vacuum has been drawn, it is also possible to partially seal the films along line 30 and then open the lines 22 and 23 to draw the vacuum.

After the drawing of vacuum through lines 22 and 23 and the partial seal has been made, the gas lines 27 and 28 are opened.

Referring again to FIGS. 5 to 9, the gas line 28 leads to the center orifices 29 in the matrices and provide passages which lead from the source of the gas to the gas orifices 29 just below the slits 20. Gas introduced through these passages is forced upwardly through the slits 20 into the enclosure provided by the partial seal. Gas may escape from the enclosure through the opening 31. Gas also is introduced into the head through the passage provided by line 27. We prefer that the pressure of the gas introduced through the slit into the enclosure be somewhat greater than that of the gas surrounding the enclosure within the chamber so that the tendency will be for gas to flow outwardly through opening 31 from the enclosure rather than inwardly into the enclosure.

We use the term "gas" to include air as well as other gases. The gas which is introduced into the chamber may be nitrogen or some other gas not harmful to the food and which is substantially free of oxygen.

After the pressure of the gas introduced into chamber D reaches a pressure which is approximately that of the atmosphere about the chamber, the lower section 21 may be lowered to open the chamber. The term "approximately" is meant to allow for some difference of pressures between the outside and inside of the chamber while still permitting the chamber to be opened without difficulty. We prefer that the gas be introduced to create a small positive pressure within the chamber prior to opening the chamber. This tends to prevent flow of air into the chamber when it is opened.

Figure 12:
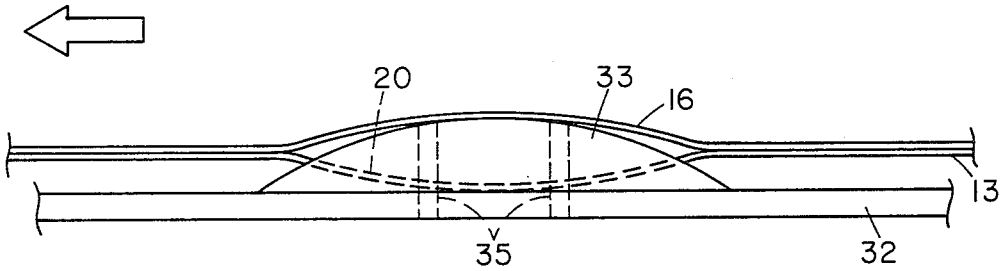
FIG. 12 is a schematic view illustrating the engagement of the nozzle with a slit in the lower film.
Figure 10:
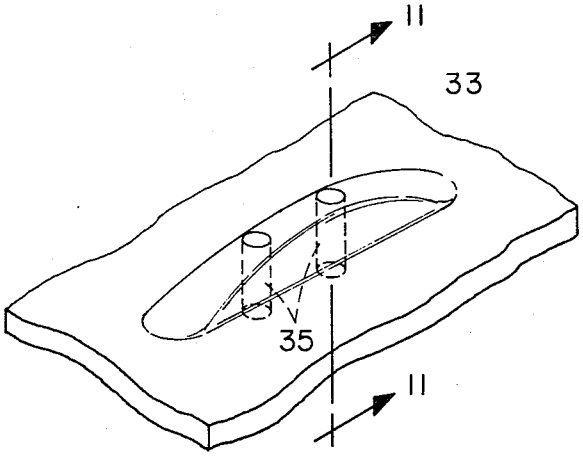
FIG. 10 is a detailed perspective view of a nozzle intended to engage the slit in the lower film.
Figure 11:
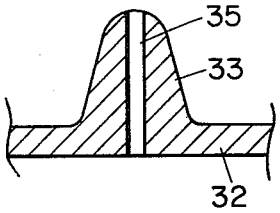
FIG. 11 is a sectional view of the nozzle taken as seen from line 11—11 of FIG. 10.

The next advance of the films passes the web which is formed in chamber D to section E. As the films move toward their position in section E, they move along over the bed 32 with the nozzles 33 (see FIG. 10) riding under the film 13 until the slits come into contact with the nozzles at which time the nozzles begin to push into the slits turning the side edges upwardly and spreading them apart. When the slits come completely into register with the nozzles, the nozzle has been inserted into the package as schematically illustrated in FIG. 12.

The nozzles 33 are provided with the internal passages 35. These passages are connected with the gas line 34, and when the web is advanced into its position where the nozzles are directly under the slits, the gas line is opened and the substantially oxygen-free gas passes through line 34 and passages 35 into the package being formed between the top film 16 and the bottom film 13 and within the line of seal 30. This causes the pressure within the line of seal 30 to be somewhat higher than outside this line of seal so that the gas passes out through the openings 31 so as to flush the package with oxygen-free gas.

Then after the chamber F is opened, the film web is again advanced to move the section of the web which has just been flushed with gas into chamber F, and this chamber is again closed.

Chamber F may be constructed identically with chamber D except that the sealing mechanism within this chamber is arranged to seal the packages individually along closed lines of seal between the top and bottom films 13 and 16 and excluding the slits 20.

Following closure of chamber F the vacuum is drawn by opening lines 38 leading from the orifices in the matrices under the slits, and also by opening line 40 leading from the head of chamber F.

While the chamber F is under the reduced pressure, the sealing mechanism is actuated and the web is completely sealed about lines 41 enclosing each food unit and excluding the slits 20.

After the vacuum is drawn and the seal about lines 41 is made, these vacuum lines 40 are closed and the gas, which may be air, is introduced into the chamber F through line 49 which may be a simple air valve. When the pressure within the chamber approximates the outside pressure, the chamber F is opened and the film web again advanced, this time to the section G.

Figure 13:
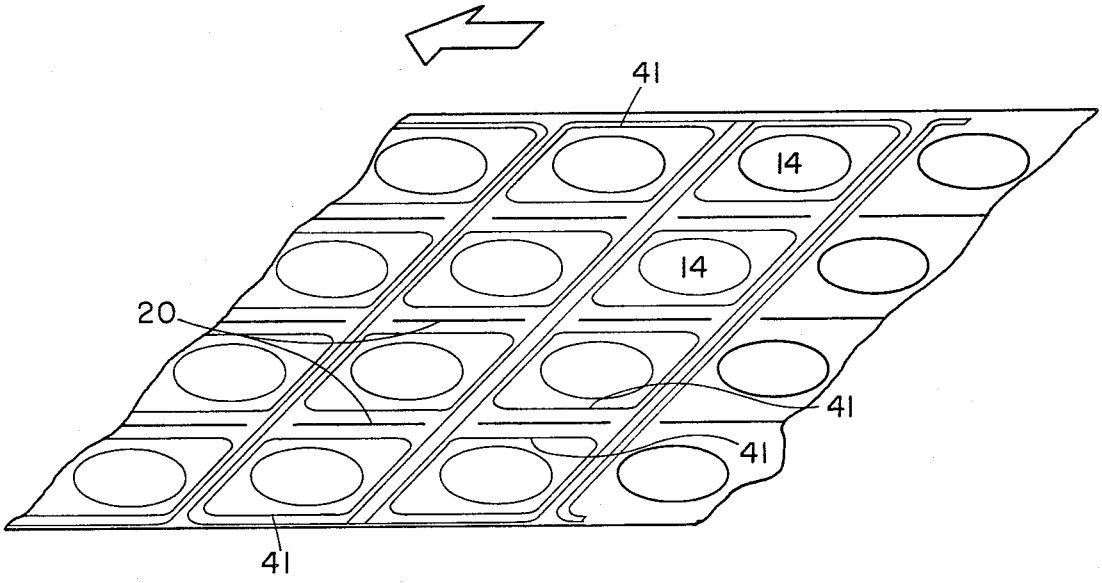
FIG. 13 is a detailed perspective view showing the condition of the web when it comes out of the second chamber.

The condition of the film web as it is advanced from chamber F is illustrated in FIG. 13. Note that the top and bottom films are sealed about the line of seal 30 and the openings 31 which previously existed in the line of seal 30 are now closed by reason of the superimposed lines of seal effected in chamber F and which, in this embodiment, embraces all eight food units contained in this section of the film web. Also the lines of seal 41 which extend individually about each food unit exclude the slits 20.

An alternate procedure involves the back-filling of the packages with nitrogen or other substantially oxygen-free gas prior to completely sealing the packages in chamber F. According to this procedure, after a vacuum has been drawn in chamber F, the vacuum lines are closed and a substantially oxygen-free gas is introduced through line 44 and upwardly through slits 20 into the space between the top and bottom films 16 and 13 and enclosed by the line of seal 30. The pressure of the gas so introduced is such as to fill this space to the extent desired, after which the complete seal is made about each individual unit, air then admitted to equalize approximately the pressures inside and outside the chamber, and the chamber F then opened to permit advancement of the web to the station G.

At station G the web is cut transversely by cutters 45 and 46 between the rows of sealed food units, and then at the end of the machine the web is cut longitudinally by cutter 47 to separate the individual packages. Suitably the longitudinal cuts coincide with the slits 20 so that the edge of the cut film is even and regular.

The above description explains a process with respect to what is done to a particular section of the web as this section moves sequentially through the process. It should be understood that in accordance with the process different sections of the web are being acted upon simultaneously in different parts of the apparatus. The lower parts of the chambers D and F and the structure 50 which carries knives 19 may all be carried by a rail which is vertically movable so that they move up and down simultaneously in response to indexing mechanism which also causes the advancement of the film web while these parts are in lowered position.

When the lower parts of chambers F and D and the knives 19 have been raised, these two chambers are closed and the knives 19 make slits in the film at C. Also this starts a timed cycle at each of chambers D and F. At chamber D valves are opened to pull a vacuum; then the vacuum lines are closed and the sealing mechanism actuated to partially seal the web. Following this, gas lines are opened to admit oxygen-free gas into the chamber, then when substantial equalization of pressure occurs the gas lines are closed.

At the chamber F a timed cycle begins after closure of this chamber which first opens the vacuum lines from that chamber, then completely seals the film about the units individually. Alternately, this cycle may be extended to admit oxygen-free gas prior to the sealing event.

At station E a cycle may be operated to turn on the gas when the web section reaches its position in this area, and to turn off the gas again when the film web is moved from this position or preferably, the gas may be left on continuously during the operation of the machine.

At station G a cycle may be started when a web section reaches its position at this station to operate the transverse cutters 45 and 46. The cutter 47 may operate continuously to sever the web as it is advanced.

The intermittent movement of the rail to raise and lower the lower parts of the chamber and the structure carrying knives 19, and the timing of events in each cycle, may be operated by hand but preferably by mechanisms known to the art. Suitably, this may be done by the operation of motor-driven cams or may be done by utilizing electronic timing apparatus. Similarly, the events in each of the cycles which take place at D, E and F may be timed and actuated by mechanical means using cams or by known electronic timing devices. It is, of course, necessary that the timing cycle at each position be completed before the chambers are opened.

As is set forth in this specification under "Background", a typical 2-ounce unit of meat consisting of a pair of bologna slices could be vacuum packed in film according to the prior practice to provide a package having an oxygen concentration of 20% and a total volume of 0.125 to 0.264 cc of oxygen still contained in the package and having a shelf life of from 30 to 60 days.

We find that by using the improvements set forth herein we can reduce the total oxygen content of the typical film-enclosed package of meat such as just referred to above to an amount less than ⅓ of that which it normally contained according to the prior practice. I am able by reason of the improvements herein described to obtain such a package having an oxygen concentration of less than 1 to 2% and a total volume of oxygen of 0.034 to 0.071 cc and a shelf life of from about 90 to 360 days depending on the type of product packaged. Such a change in shelf life in a meat product gives a very substantial advantage in the distribution and marketing of meat or other food items.

There are several features about our process to which we attribute this improvement. We believe that our process is substantially more effective in removing oxygen particularly from the spaces between the slices and within the meat itself.

A feature of the process which is believed to contribute to the improvements is the use of two chambers into which the package is successively passed as the package is formed whereby a vacuum may be drawn in the first of the chambers and back-filled with an oxygen-free gas, and then vacuumized and sealed in the second chamber. Another feature is the flushing of the partially-formed package while it is in a position between the two chambers with a substantially oxygen-free gas. Yet another feature is the use of gas lines for admitting gas into the partially formed package which are separate from the vacuum lines used to withdraw gas from the chamber whereby the oxygen contained in the withdrawal lines is not passed back into the package when gas is introduced as was previously the practice.

Another feature lies in the use of a gas for back-filling the package as it is being formed which gas itself has a low content of oxygen. The prior practice has been to use a gas such as nitrogen combined with from 50 to 90% of $CO_2$. In our process we prefer to use either nitrogen or other substantially oxygen-free gas by itself or use such a gas combined with not more than 2 to 10% of $CO_2$. This provides the advantages of having the $CO_2$ present without the disadvantage of significantly increasing the concentration of oxygen.

Yet another feature is the injection of substantially oxygen-free gas in the form of a jet through a slit in the lower film, and another feature is that of locating openings to the vacuum lines below the slit in the lower film so that the side edges of the slit are drawn down to enlarge the opening provided by the jet and facilitate the introduction of gas into the package being formed. Another feature is the use of the special nozzle which rides under the bottom film until a slit is advanced to a position over the nozzle and between the two chambers where it then serves to turn up the edges of the slit and provide an effective way to introduce the oxygen-free gas at the station where flushing takes place. Also, other features not above referred to will be found which also serve in producing the results achieved by this invention.

While only one embodiment of the invention together with certain variations therein has been described in detail, it will be apparent to those skilled in this art that many changes may be made and the invention practiced in many particular ways, all within the spirit of the invention and within the scope of the appended claims.

What is claimed is:

1. A process for packaging foods comprising passing a unit of food between a top film and a bottom film into an open first chamber, said bottom film having an opening therein to one side of said unit, withdrawing air from said first chamber through a passage which is open at a position below said opening, whereby pressure within said chamber is reduced, sealing said top and bottom films along a line which extends about said unit and encloses said opening, introducing a gas which is substantially free of oxygen through a passage which opens at a position under said opening whereby to pass said gas upwardly through said opening and into the enclosure between said films until the presssure within said chamber is approximately that of the atmosphere surrounding said chamber, opening said chamber, passing said unit with said enclosure out of said chamber to a position in which a nozzle engages said opening, passing gas which is substantially free of oxygen through said nozzle and into said enclosure to flush said enclosure, passing said unit which has been flushed within said enclosure into an open second chamber, closing said second chamber, withdrawing gas from said second chamber through an outlet passage which is open at a position under said opening to draw gas through said opening and out of said second chamber through said outlet passage, and sealing said top and bottom films along a line extending about said unit and excluding said opening.

2. A process for packaging foods comprising passing a unit of food between a top film and a bottom film into an open first chamber, said bottom film having an opening therein to one side of said unit, withdrawing air from said first chamber through a passage which is open at a position below said opening, whereby pressure within said chamber is reduced, sealing said top and bottom films along a line which extends about said unit and encloses said opening, introducing a gas which is substantially free of oxygen through a passage which opens at a position under said opening whereby to pass said gas upwardly through said opening and into the enclosure between said films until the pressure within said chamber is approximately that of the atmosphere surrounding said chamber, opening said chamber, passing said unit within said enclosure out of said chamber to a position in which a nozzle engages said opening, passing gas which is substantially free of oxygen through said nozzle and into said enclosure to flush said enclosure, passing said unit which has been flushed within said enclosure into an open second chamber, closing said second chamber, withdrawing gas from said second chamber through an outlet passage which is open at a position under said opening to draw gas through said opening and out of said second chamber through said outlet passage, passing gas which is substantially free of oxygen through a passage into said second chamber to a position below said opening whereby gas is passed upwardly through said opening into the enclosure between said top and bottom films, and sealing said top and bottom films along a line extending about said unit and excluding said opening.

3. In a process for packaging foods comprising passing a unit of food while between a top film and a bottom film having a slit therein into an open first chamber, closing said first chamber with said film and unit therein, drawing air through a passage leading from said first chamber to reduce air pressure within the said first chamber and to reduce the amount of oxygen about said food unit, closing said passage, introducing into said first chamber a gas which is substantially free of oxygen until the pressure within said first chamber is approximately that of the atmosphere surrounding said first chamber, while said food unit is in said first chamber between said top and bottom films sealing said top and bottom films along a line extending about said unit except for one or more spaces to provide a partial seal whereby to leave an opening between said films through which gas may escape from the film enclosure about said unit, when the pressure within said first chamber is substantially that of the surrounding atmosphere opening said first chamber, passing said unit enclosed by said top and bottom films from said first chamber to an intermediate position in which a nozzle engages said slit, passing gas which is substantially free of oxygen through said nozzle and through said slit into the enclosure between said films and within said line of partial sealing whereby gas passed into said enclosure may pass out through said opening provided by partial sealing to flush the enclosure with said gas, passing said food unit with said bottom film beneath and a top film above said unit into an open second chamber, closing said second chamber, then withdrawing gas from a passage leading from said second chamber to reduce the pressure within said second chamber and to further reduce the amount of oxygen about said food, and thereafter sealing said top and bottom films together along a line extending about said unit.

4. A process for packaging foods comprising passing a bottom film with a unit of food thereon into an open first chamber, closing said first chamber with said film and unit therein, drawing air through a passage leading from said first chamber to reduce air pressure within said first chamber and to reduce the amount of oxygen about said food unit, closing said passage, introducing into said first chamber a gas which is substantially free of oxygen until the pressure within said first chamber is approximately that of the atmosphere surrounding said first chamber, opening said first chamber, passing said film and food unit out of said first chamber, passing said food unit with said bottom film beneath and a top film above said unit into an open second chamber, closing said second chamber, then withdrawing gas through a passage leading from said second chamber to reduce the pressure within said second chamber and to further reduce the amount of oxygen about said food, sealing said top and bottom films together along a line extending about said unit, and passing substantially oxygen-free gas between said top and bottom film after the film and food unit has left said first chamber and before it has entered said second chamber to flush the area about said unit with substantially oxygen-free gas.

5. In a process for packaging foods wherein a unit of food on a bottom film is passed into a first chamber, a vacuum drawn in said first chamber and said first chamber backfilled with a gas which is substantially free of oxygen until the pressure within said chamber is substantially that which surrounds the first chamber, said food unit while between said bottom film and a top film being passed from said first chamber into a second chamber, and a vacuum drawn in said second chamber, said films being sealed together about said food unit while within said second chamber, the improvement which includes flushing said food unit with a gas which is substantially free of oxygen after said food unit has left said first chamber and before it enters said second chamber.

6. A process as set forth in claim 5 including the steps of slitting said bottom film to form a slit at a place to one side of said food unit and passing said gas through said slit and into contact with said food unit to flush said food unit.

7. A process as set forth in claim 6 which includes discharging said gas through a nozzle located between said chambers when said bottom film is passed to a position in which said slit is in register with said nozzle.

8. A process as set forth in claim 6 including the steps of partially sealing said top and bottom films about said unit to thereby form an enclosure for said food unit and said slit and leave an opening through which said gas may escape from said enclosure.

9. In a process for packaging food the steps of passing into a chamber a food unit on a bottom film, said bottom film having a slit therein to one side of said food unit, drawing a vacuum in said chamber, and then passing into said chamber and through said slit a gas which is substantially free of oxygen to flush said unit, said gas being passed from beneath said bottom film upwardly through said slit in the form of a jet, thereafter drawing a vacuum on said food unit while enclosed between said bottom film and a top film, withdrawing air from a position below said slit to thereby draw downwardly the lips of said slit to thereby provide a widened opening, said withdrawal being done prior to introduction of gas through said opening, and sealing said top and bottom films at a line extending about said food unit but excluding said slit.

10. In a process for packaging foods in which food unit between a top film and a bottom film is flushed with a gas which is substantially free of oxygen, the steps of slitting said bottom film to form a slit therein, moving said food unit between said top and bottom films on a bed having a nozzle projecting upwardly of said bed with the discharge end of a stationary nozzle projecting upwardly above said bed and against the bottom of said bottom film, whereby said bottom film rides over said nozzle until said slit comes into register with said nozzle and said nozzle enters said slit, and while said nozzle is in engagement with said slit, discharging said gas upwardly through said nozzle and about said food unit between said films.

11. A process as set forth in claim 10 in which said nozzle is elongated in a direction aligned with the direction of movement of said bottom film and has downwardly inclined surfaces from a central portion toward said bed to thereby facilitate movement of said nozzle into and out of said slit as said bottom film is passed along said bed.

12. A process as set forth in claim 11 wherein said gas is discharged upwardly through a passage in said central portion of said nozzle.

* * * * *